US005106140A

United States Patent [19]

Knotts

[11] Patent Number: 5,106,140

[45] Date of Patent: Apr. 21, 1992

[54] OIL-FIELD WIRELINE FISHING TOOL

[76] Inventor: Edgar E. Knotts, Rte. 11, Box 413, Laurel, Miss. 39440

[21] Appl. No.: 509,249

[22] Filed: Apr. 16, 1990

[51] Int. Cl.[5] ..... E21B 31/00

[52] U.S. Cl. ..... 294/86.13; 294/86.1; 294/86.26

[58] Field of Search ..... 294/86.1, 86.11, 86.12, 294/86.13, 86.16, 86.24, 86.25, 86.26, 86.28, 86.32

[56] References Cited

U.S. PATENT DOCUMENTS

| | | | |
|---|---|---|---|
| 750,491 | 1/1904 | Sargert . | |
| 868,809 | 10/1907 | Rathbone . | |
| 1,148,495 | 8/1915 | Birdseye | 294/86.28 X |
| 1,494,880 | 5/1924 | Ausbrooks . | |
| 1,509,001 | 9/1924 | Smith | 294/86.32 |
| 1,528,145 | 3/1925 | Davidson | 294/86.12 |
| 2,236,761 | 9/1938 | Nichols . | |
| 2,621,067 | 12/1952 | Jacobson | 294/86.32 |
| 2,853,335 | 9/1958 | Mogle | 294/86.32 |
| 4,515,212 | 5/1985 | Krugh . | |
| 4,545,432 | 10/1985 | Appleton . | |
| 4,603,739 | 8/1986 | Krugh . | |

*Primary Examiner*—Margaret A. Focarino
*Assistant Examiner*—Dean J. Kramer
*Attorney, Agent, or Firm*—Cushman, Darby & Cushman

[57] ABSTRACT

The present invention is an oilfield wireline fishing tool with expansible wings. The wings open up in umbrella fashion after leaving production tubing allowing the fishing tool to cover the entire diameter of the well casing. Upon reentry into tubing the wings compress enabling the fishing tool and lost tool to be pulled to the surface. The wings are secured to the tool by leaf springs. A collar is placed over the leaf springs at the down-hole end of the tool in order to secure the leaf springs to the tool. This design allows the tool to be constructed with a diameter small enough to fit through production tubing. The uphole end is suited for attachment to a wireline bridle.

8 Claims, 4 Drawing Sheets

OIL-FIELD WIRELINE FISHING TOOL

BACKGROUND OF THE INVENTION

1. Field of the Invention

This invention relates to a device for retrieving tools lost in petroleum wells. More specifically, the present invention is an improvement of present fishing tools suited for use through tubing in cased hole wells.

2. Description Of The Related Art

There are various methods of completion and production of an oil well, gas well, or the like. Regardless of the method utilized in a particular well, there will invariably be a well casing and production tubing installed in the well. The well casing is essentially a pipe that is installed into the borehole for substantially the entire depth of the well. Casing is typically from 8 to 14 inches in inner diameter, depending on the diameter of the drill bit used to drill the well.

Production tubing is a tubing of smaller diameter, typically about 2 to 4 inches in inner diameter, that is set in a portion of the well somewhat concentric with the casing. The tubing allows communication of the producing zone of the well with the surface. The tubing is held in place by packers that are essentially elongated toroids with an outer diameter close to the inner diameter of the casing and an inner diameter close to the outer diameter of the tubing.

After the tubing and casing are installed in the borehole there is often need for various procedures to be performed on the well, such as gamma ray correlation to open hole electric logs, perforation, and the like. These procedures are performed by tools that are attached to what is known as a wireline. The wireline is a cable with a plurality of electrical conductors contained therein. The tools are lowered into the well on the end of the wireline and activated or monitored at the surface by an operator.

Occasionally, for various reasons, a tool becomes detached from the wireline and is lost in the well. Many times these tools are very expensive pieces of electronic instrumentation and/or have radioactive sources contained therein and must be retrieved. This procedure of retrieving the lost tool is known as fishing. The fishing tool has a "grappling" mechanism, or latching device, and is also lowered into the well on the end of a wireline.

The cased-hole wireline tool must be able to ascend through the tubing into the casing, where tools are typically lost. This presents a problem. In order to be able to ascend through the tubing the diameter of a fishing tool must be smaller than the inner diameter of the tubing. Thus, the fishing tool cannot cover the whole diameter of the casing. For example if the lost tool is decentralized, because it is leaning against the casing or it is stuck to the casing for various reasons, the fishing tools of the prior, due to their small diameter, art will most likely pass right by the lost tool without catching the lost tool in its grappling mechanism.

Expansible wings have been utilized in the prior art on devices adapted for oil-field fishing in order to allow a fishing tool to cover the entire diameter of a well bore. In particular, U.S. Pat. No. 366,445 to Rathbone discloses a tool for open-hole fishing used on the end of drill pipe. Since the Rathbone tool is run on the end of drill pipe, a drilling rig must be in place. This is not typically the case after a well has been completed and it would require great expense to locate a rig at a well for such a purpose. In addition even if a rig were located at the well site the Rathbone tool is not capable of being constructed in a diameter small enough to allow it to ascend through tubing. Indeed, the drill pipe is too large and the hinge and pin method of attaching the wings on Rathbone is too bulky. For these reasons, the Rathbone fishing tool is suited solely for fishing before tubing has been installed.

SUMMARY OF THE INVENTION

The present invention utilizes expansible wings that allow it to be lowered through tubing. When the fishing tool of the present invention comes out of tubing and into casing, the expansible wings open up, in umbrella fashion, allowing the tool to cover the whole diameter of the casing. After the lost tool is secured in the latching device of the present invention, the wings can compress allowing the fishing tool and the lost tool to be pulled back up through the production tubing.

The wings are mounted on leaf springs that are secured to the tool with a collar. This design allows the present invention to be constructed with a diameter under 2 inches. The hinge and pin method of Rathbone is not at all suited for construction of a tool in the relatively small diameters necessary for descent through production tubing. Further, the latching device is fully contained within the fishing tool but can be released to secure the lost tool at a position outside of the fishing tool, allowing the wings to fully compress to the minimum tool diameter upon ascent into tubing. The prior art discloses no such means for locating the lost tool outside of the fishing tool after it has been latched by the fishing tool.

The fact that the present invention can ascend through production tubing has many practical and economic advantages. For example, expensive pieces of equipment that interfere with production can be retrieved from producing wells. Tools lost very close to the "rathole" right below the tubing can more readily be recovered since the wings of the present invention expand to cover the entire borehole soon after the tool is out of tubing.

Other objects, features and characteristics of the present invention, as well as the methods of operation and function of the related elements of the structure, and the combination of parts and economies of manufacture, will become more apparent upon consideration of the following detailed description and the appended claims with reference to the accompanying drawings all of which form a part of this specification.

BRIEF DESCRIPTION OF THE DRAWINGS

FIG. 1(*b*) is a side view of one leaf spring and one wing of the preferred embodiment of the present invention;

FIG. 1(*c*) is the same leaf spring and wing of FIG. 1(*b*) rotated 90 degrees;

FIG. 2(*b*) is the preferred embodiment of the present invention as it would appear soon after it leaves the production tubing and enters the well casing;

FIG. 3(*b*) is a section view of the bottom potion of the housing revealing the latching device after it has moved downhole relative to the tool housing.

DETAILED DESCRIPTION OF THE PREFERRED EMBODIMENT

Figure 1A:
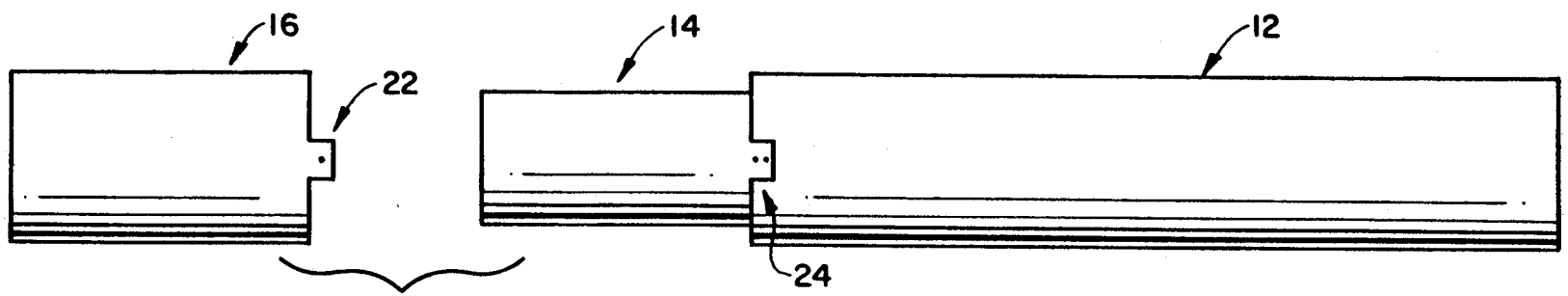
FIG. 1(*a*) is a side view of the housing, base and collar portions of the preferred embodiment of the present invention before assembly.
Figure 1B:
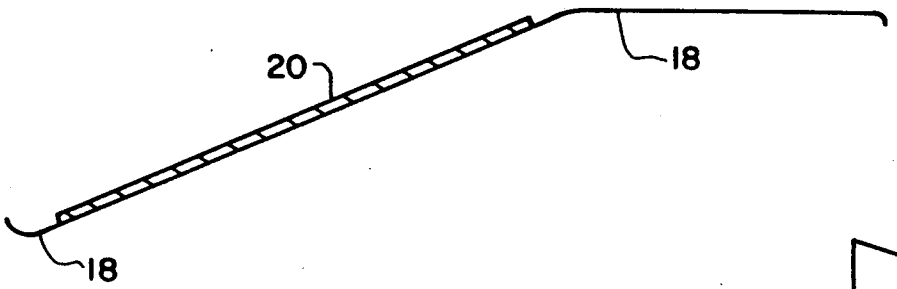
Figure 1C:
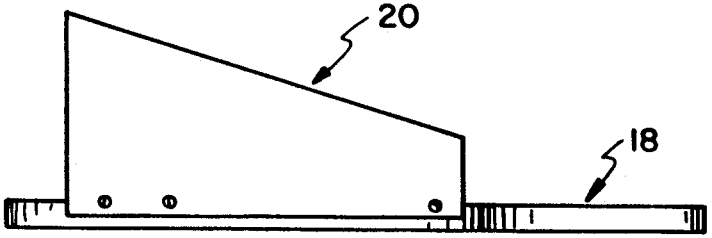

FIGS. 1(*a*), 1(*b*), and 1(*c*) illustrate the different elements of the preferred embodiment of the present invention before assembly. The hollow cylindrical tool housing 12 has a base 14 at its downhole end. The base 14 is also of a hollow cylindrical construction. The diameter of the base 14 is slightly less than that of the housing 12. The diameter of the housing 12 is selected to allow ascent through the production tubing of a well, e.g. less than 2".

The leaf springs 18 each have a wing 20 attached thereto as illustrated in FIGS. 1(*b*) and 1(*c*) (only one of each are illustrated for purposes of clarity). Several leaf springs 18 are arranged equidistantly around the surface of the base 14. The downhole portion of the springs 18 are then elasticly bent toward the axis of the tool housing and a collar 16 is slipped over the base 14 and the flat portion of the leaf springs 18. The collar 16 is then secured with a bolt through holes at 22 and 24.

Figure 2A:
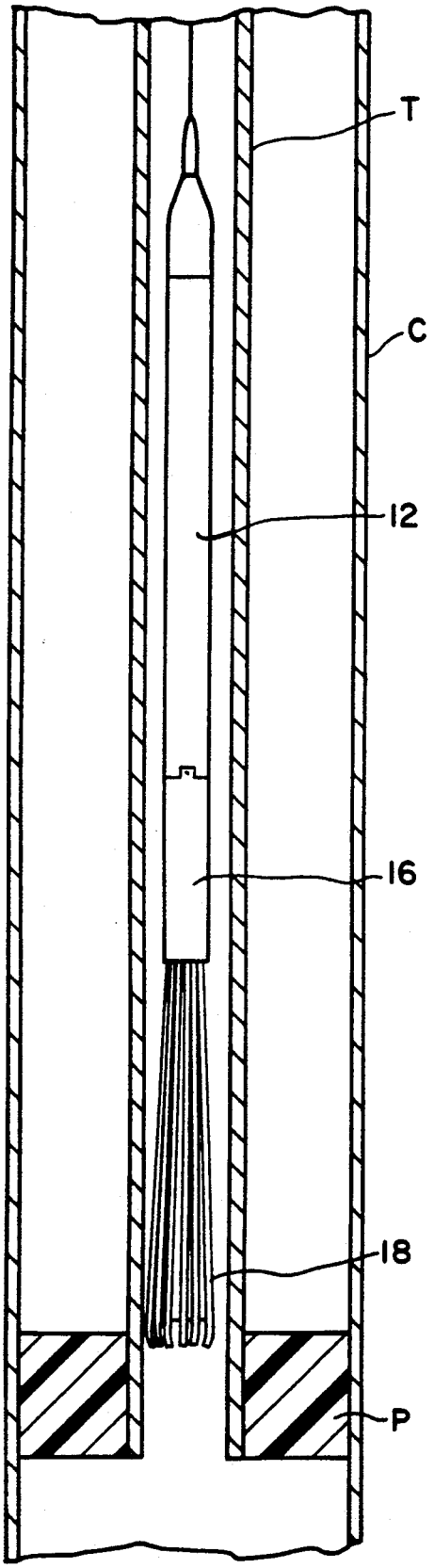
FIG. 2(*a*) is the preferred embodiment of the present invention as it would appear just before it leaves the production tubing.
Figure 2B:
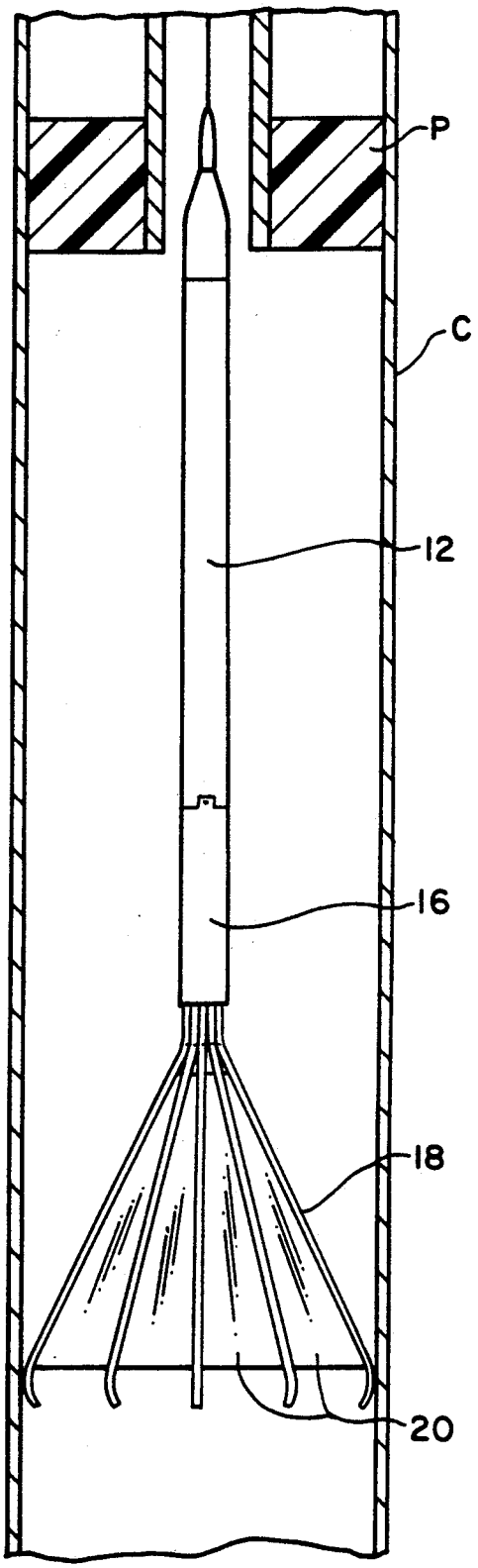

The leaf springs 18 and wings 20 are now fixedly attached to the tool body 12 by means of the collar 16. The wings 20 are constructed of a very thin metal, or the like, allowing the leaf springs 18 to collapse to a minimum diameter, substantially equal to the diameter of the tool housing, while the wings 20 overlap each other and fold up as seen in FIG. 2(*a*). Note that the wings 20 of the preferred embodiment terminate a small distance below the collar 16 defining a space therebetween. Borehole fluid may flow through the space, allowing a smoother descent. In the absence of external forces, such as when the tool is in the well casing, the leaf springs 18 and the wings 20 expand into an umbrella-like configuration as seen in FIG. 2(*b*). Note that the wings 20 of the preferred embodiment are attached to the inside of the leaf springs 18 and that the leaf springs 18 are bent towards the tool axis at a bottom portion allowing the springs 18 to act as guide surfaces during descent down the well bore.

Figure 3A:
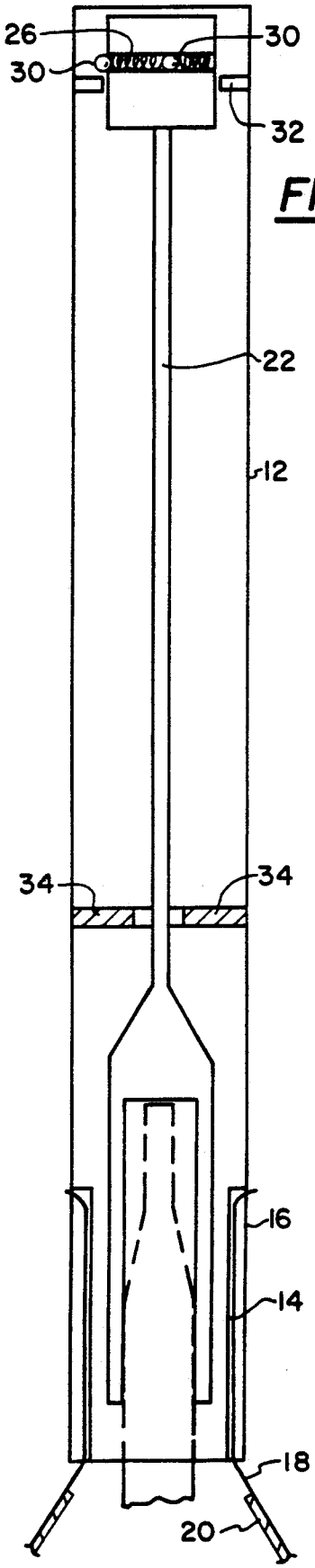
FIG. 3(*a*) is a section view of the housing of the preferred embodiment revealing the modified latching device.
Figure 3B:
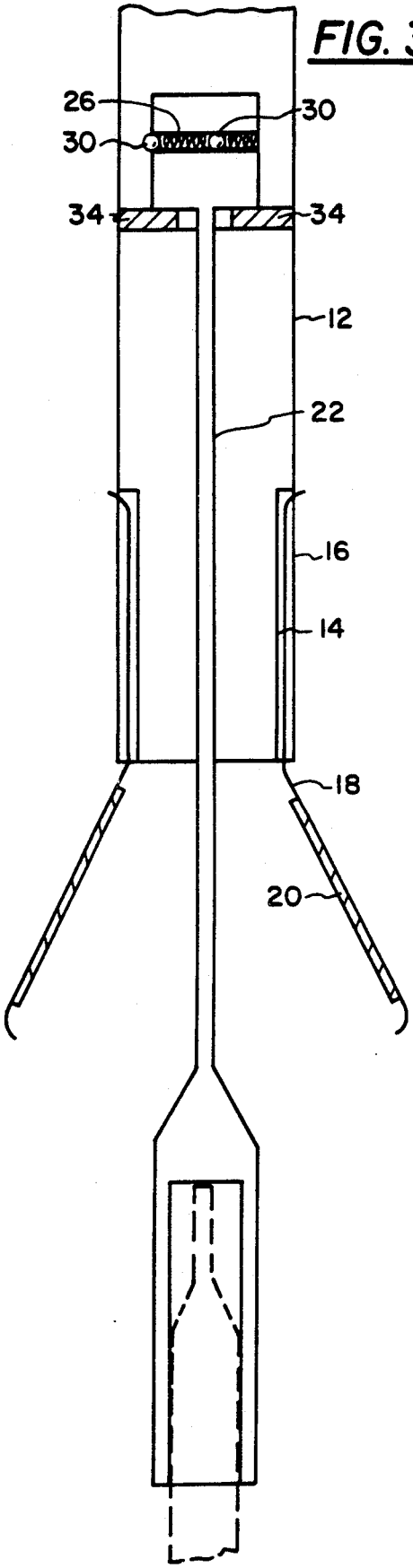

FIG. 3 illustrates the latching tool 22 that is enclosed within the housing 12. The latching tool 22 can be a standard latching device that is readily available. However in the preferred embodiment a standard latching device has been modified so as to allow the latching tool 22 to be completely contained within the tool housing 12 before latching onto a lost tool and then to move in a downhole direction relative to the tool housing 12 after the lost tool is latched. This allows the lost tool to be latched and carried outside of the housing 12 and below the leaf springs 18 thus enabling the leaf springs 18 and the wings 20 to completely collapse upon reentry into the production tubing.

Figure 4:
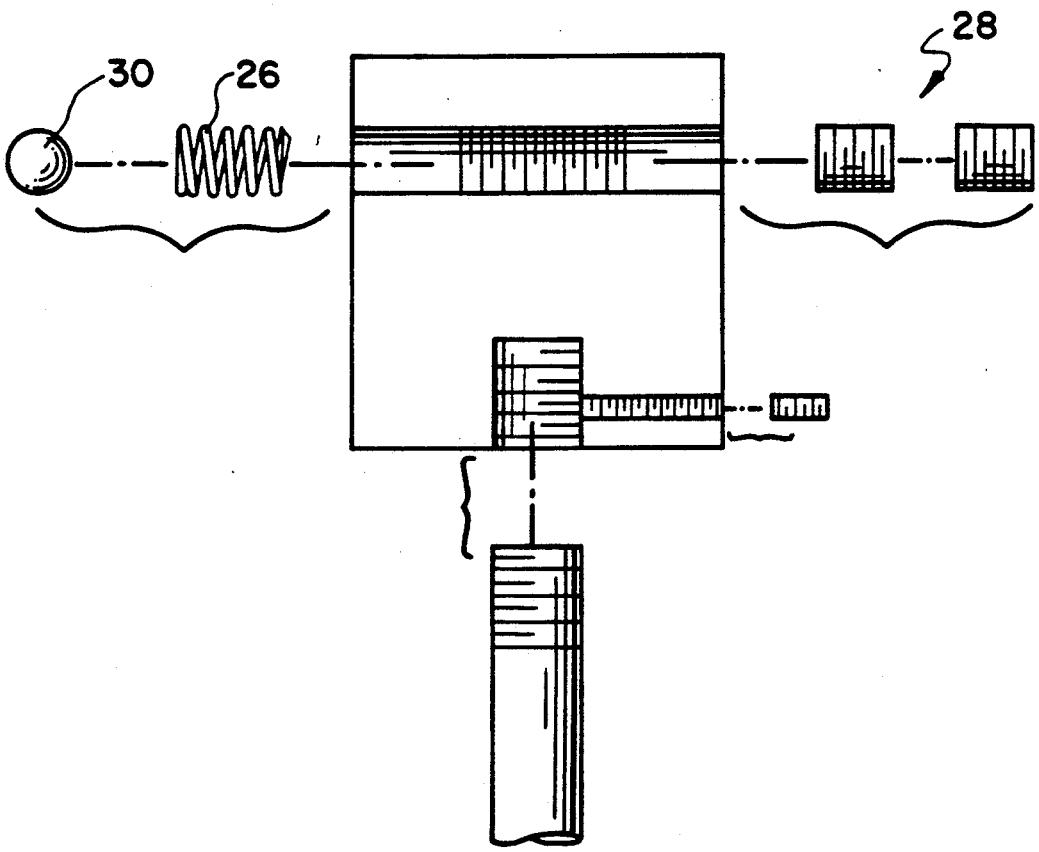
FIG. 4 is an exploded view of the pressure sensitive release device allowing a lost tool to be carried outside of the fishing tool.

FIG. 4 illustrates the pressure sensitive release device that allows the lost tool to be carried outside of the fishing tool. A spherical element 30 partially protrudes from a bore that is formed in the uphole portion of the latching tool 22. A spring 26 forces the spherical element 30 against the inner surface of the housing 12. A set screw 28 is threaded into place on the opposite side of the spring 26 allowing adjustment of the spring tension by advancing and retreating the set screw 28.

An annular ring 32 on protruding from the inside of the housing 12 engages with the spherical element 30 prohibiting the latching tool 22 from moving downhole relative to the tool body 12. However, if an adequate force is applied, to the latching tool 22, in a downhole direction the spring force will be overcome and the spherical element 30 will pass by the annular ring 32. When this happens, the latching tool 22 will move downhole relative to the housing 12 until stopped by appropriate stops 34 in the housing 12. This is illustrated in FIG. 3(*b*). In operation, the set screw 28 will be adjusted so as to allow the weight of the lost tool in fluid to overcome the spring force and allow the latching tool 22 to move relative to the housing 12 after latching the lost tool.

In operation, the present invention is lowered, on a wireline, into a cased hole well in which a tool has been lost. A clamp, used to hold the expansible wings 20 closed, is removed upon entry into the production tubing. At this point the wings 20 will be held closed by the tubing T as seen in FIG. 2(*a*). After being lowered to a depth corresponding to the termination of the tubing T, the wings 20 of the fishing tool will open up to conform to the increased diameter of the well casing C. At this point the fishing tool appears as in FIG. 2(*b*).

In this manner, the fishing tool may continue to be lowered down the well bore until it "pushes over" the lost tool. This is sensed uphole by a change on a weight sensing device. Since the wings 20 essentially cover the entire diameter of the well casing, the lost tool will be centralized as the fishing tool pushes over it and the lost tool will be latched into the grappling device of the latching tool 22.

After the lost tool is latched, the fishing tool, along with the lost tool, is pulled up the well bore towards the surface. The force of the wireline against the lost tool will urge the spherical element 26 past the annular 32 allowing the latching device 22 to move in the downhole direction with respect to the fishing tool. This allows the lost tool, now latched in the latching device 22, to be carried completely outside of the fishing tool.

Upon reentry into the production tubing T, the expansible wings 20 collapse due to the decrease in diameter. Since the lost tool is carried outside of the fishing tool the expansible wings 20 are free to collapse to a minimum tool diameter allowing smooth ascent through tubing T to the surface.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed:

1. A through tubing, cased hole, wireline fishing tool, comprising:

a tool housing of essentially a tubular form and having a longitudinal axis and up-hole and down-hole ends;

means for coupling said fishing tool to a wireline bridle apparatus disposed at said up-hole end;

a tool base attached to said down-hole end of said tool housing, said tool base being essentially a continuation of said tool housing and having an axis that is concentric with said tool housing;

a plurality of leaf springs each having a fixed end and a free end, said leaf springs being of a curved shape;

said fixed end of each of said leaf springs being disposed on an outer peripheral surface of said tool base and extending, in a downhole direction, radially away from said axis of said tool base;

a tubular collar, said collar being disposed in surrounding relation to said fixed ends and said downhole end so as to fixedly hold a portion of said leaf springs near said fixed end in contact with said outer surface of said tool base;

a plurality of wings, each of said wings being fixedly attached to one of said leaf springs along a portion of said free end of said leaf springs;

latching means located within said tool for latching on to a lost piece of equipment; and said curvature of said leaf springs being such that said wings will expand from an overlapped position corresponding to a minimum diameter to conform to a casing inner diameter of said cased-hole well.

2. A through tubing, cased-hole, wireline fishing tool as described in claim 1, wherein said minimum diameter is preselected so as to allow said fishing tool to pass through tubing contained in a portion of said well.

3. A through tubing, cased-hole, wireline fishing tool as described in claim 1, wherein said wings are attached to a surface of said leaf springs closest to said longitudinal axis of said tool housing.

4. A through tubing, cased-hole, wireline fishing tool as described in claim 1, further comprising:

a pressure sensitive mechanism, said mechanism holding said latching means substantially inside of said tool housing before latching on to a lost tool and said mechanism releasing said latching means when said lost tool exerts a force on said mechanism upon withdrawal so as to allow a portion of said latching means that is latched onto said lost tool to be located outside of said tool housing and below said wings thus allowing said wings to fully collapse, to said minimum diameter, upon reentry into tubing of said cased hole.

5. A through tubing, cased-hole, wireline fishing tool as described in claim 4, wherein said pressure sensitive mechanism comprises;

a first salient portion extending from an inside surface of said tool housing; and a second salient portion extending from said latching means and engaging with said first salient portion when said latching means is held within said tool housing, said second salient portion having elastic qualities so as to allow release of said engagement when a predetermined force is applied to said latching means.

6. A through tubing cased-hole wireline fishing tool as described in claim 5, wherein said first salient portion is an annular ring protruding from said inside surface of said tool housing; and said second salient portion comprises;

a sphere protruding partially through a bore that has been formed through said latching mechanism perpendicular to said axis of said tool housing;

a spring located behind said sphere, urging said sphere into engagement with said annular ring;

threads formed in at least a portion of said bore; and at least one set screw threadedly engaged with said threads in such a way as to restrict movement of said spring at an end opposite to said sphere.

7. A through tubing, cased-hole, wireline fishing tool as described in claim 1, wherein said leaf springs are curved toward the axis of said tool housing at a portion of said leaf springs furthest from said tool body so as to create a tapered radius at a bottom portion of said tool allowing said leaf springs acting as guide surfaces during descent, by said fishing tool, into a well bore.

8. A through tubing, cased hole, wireline fishing tool as described in claim 1, wherein said wings are attached to said leaf springs so as to define a series of open spaces, between each of said leaf springs and an adjacent of said leaf springs at a position adjacent to said tool base, said open spaces allowing borehole fluids to flow therethrough.

* * * * *